US011065893B2

(12) United States Patent
Tsai

(10) Patent No.: US 11,065,893 B2
(45) Date of Patent: Jul. 20, 2021

(54) PICKUP MECHANISM

(71) Applicant: Foxlink Image Technology Co., Ltd., New Taipei (TW)

(72) Inventor: Wei Xiang Tsai, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 153 days.

(21) Appl. No.: 16/547,622

(22) Filed: Aug. 22, 2019

(65) Prior Publication Data

US 2020/0307276 A1 Oct. 1, 2020

(30) Foreign Application Priority Data

Mar. 28, 2019 (TW) ..... 108203831

(51) Int. Cl.

| | |
|---|---|
| ***B65H 3/34*** | (2006.01) |
| ***B65H 3/56*** | (2006.01) |
| ***B41J 13/10*** | (2006.01) |
| ***B65H 5/06*** | (2006.01) |

(52) U.S. Cl.

CPC ..... *B41J 13/103* (2013.01); *B65H 5/062* (2013.01); *B65H 2301/333* (2013.01); *B65H 2601/11* (2013.01)

(58) Field of Classification Search

CPC . B65H 3/34; B65H 3/56; B65H 3/063; B65H 3/46; B65H 3/54; B65H 2404/722; B65H 2404/725; B65H 5/062; B65H 2601/11; B65H 2301/333; B41J 13/103

See application file for complete search history.

(56) References Cited

U.S. PATENT DOCUMENTS 5,004,218 A * 4/1991 Sardano ..... B65H 3/46 221/231
5,718,424 A * 2/1998 Nakatani ..... B65H 3/5238 271/121
8,876,103 B2 * 11/2014 Kasashima ..... B65H 5/06 271/121
8,894,062 B1 * 11/2014 Chen ..... B65H 3/565 271/137
10,106,351 B2 * 10/2018 Lin ..... B65H 5/36

(Continued)

FOREIGN PATENT DOCUMENTS

JP 06321380 A * 11/1994
JP 07215521 A * 8/1995

*Primary Examiner* — Luis A Gonzalez
(74) *Attorney, Agent, or Firm* — Lin & Associates Intellectual Property, Inc.

(57) ABSTRACT

A pickup mechanism includes a paper feeding channel, a pickup roller assembly disposed in the paper feeding channel and projecting beyond a top of the paper feeding channel, a paper tray disposed to an upstream of the pickup roller assembly, and a guiding swing arm assembly. The guiding swing arm assembly includes two guiding swing arms mounted adjacent to and spaced from two opposite sides of the pickup roller assembly. Each guiding swing arm includes a pivoting shaft, a stopping block, and an extending arm connected between the pivoting shaft and the stopping block. The two stopping blocks of the two guiding swing arms are disposed between the pickup roller assembly and the paper tray for blocking paper. An axial direction of the pivoting shaft of each guiding swing arm is deviated from a center axis direction of the pickup roller assembly.

18 Claims, 15 Drawing Sheets

(56) References Cited

U.S. PATENT DOCUMENTS

| | | | | |
|---|---|---|---|---|
| 2015/0274453 | A1* | 10/2015 | Juan | B65H 3/0607<br>271/117 |
| 2016/0167902 | A1* | 6/2016 | Cheng | B65H 3/56<br>271/121 |
| 2018/0179002 | A1* | 6/2018 | Lin | B65H 3/063 |

* cited by examiner

PICKUP MECHANISM

CROSS-REFERENCE TO RELATED APPLICATION

The present application is based on, and claims priority form, Taiwan Patent Application No. 108203831, filed Mar. 28, 2019, the disclosure of which is hereby incorporated by reference herein in its entirety.

BACKGROUND OF THE INVENTION

1. Field of the Invention

The present invention generally relates to a pickup mechanism, and more particularly to a pickup mechanism for improving a paper jam condition.

2. The Related Art

Currently, a paper feeding device includes a pickup mechanism. The pickup mechanism includes a paper feeding roller, a paper tray disposed to an upstream of the paper feeding roller, and a paper guiding swing arm disposed between the paper feeding roller and the paper tray. The paper feeding device is existed for applying the paper guiding swing arm to isolate the feeding roller from the paper tray. The paper guiding swing arm rotates freely along a pivoting shaft perpendicular to a paper feeding direction, and the paper guiding swing arm rotates to a position between the paper feeding roller and the paper tray under an action of the paper guiding swing arm's own weight to block paper.

However, the above-mentioned pickup mechanism often causes a paper jam condition, consequently, the pickup mechanism picks up the paper abnormally.

SUMMARY OF THE INVENTION

An object of the present invention is to provide a pickup mechanism. The pickup mechanism includes a paper feeding channel, a pickup roller assembly disposed in the paper feeding channel and projecting beyond a top of the paper feeding channel, a paper tray disposed to an upstream of the pickup roller assembly, and a guiding swing arm assembly. The guiding swing arm assembly includes two guiding swing arms mounted adjacent to and spaced from two opposite sides of the pickup roller assembly. Each guiding swing arm includes a pivoting shaft, a stopping block, and an extending arm connected between the pivoting shaft and the stopping block. The two stopping blocks of the two guiding swing arms are disposed between the pickup roller assembly and the paper tray for blocking paper. An axial direction of the pivoting shaft of each guiding swing arm is deviated from a center axis direction of the pickup roller assembly. The two pivoting shafts of the two guiding swing arms of the guiding swing arm assembly are disposed at a downstream of the pickup roller assembly.

Another object of the present invention is to provide a pickup mechanism. The pickup mechanism includes a paper feeding channel, a pickup roller assembly disposed in the paper feeding channel and projecting beyond a top of the paper feeding channel, a paper tray disposed to an upstream of the pickup roller assembly, and a guiding swing arm assembly. The pickup roller assembly includes a rotation shaft, and two pickup rollers mounted around the rotation shaft. The guiding swing arm assembly includes two guiding swing arms mounted adjacent to and spaced from two opposite sides of the pickup roller assembly. Each guiding swing arm includes a pivoting shaft, a stopping block, and an extending arm connected between the pivoting shaft and the stopping block. The two stopping blocks of the two guiding swing arms are disposed between the pickup roller assembly and the paper tray for blocking paper. An axial direction of the pivoting shaft of each guiding swing arm is parallel with a paper feeding direction of the paper feeding channel. The extending arms of the two guiding swing arms contact with two opposite sides of the two pickup rollers of the pickup roller assembly.

Another object of the present invention is to provide a pickup mechanism. The pickup mechanism includes a paper feeding channel, a pickup roller assembly disposed in the paper feeding channel and projecting beyond a top of the paper feeding channel, a paper tray disposed to an upstream of the pickup roller assembly, and a guiding swing arm assembly. The guiding swing arm assembly includes two guiding swing arms mounted adjacent to and spaced from two opposite sides of the pickup roller assembly. Each guiding swing arm includes a pivoting shaft, a stopping block, and an extending arm connected between the pivoting shaft and the stopping block. The two stopping blocks of the two guiding swing arms are disposed between the pickup roller assembly and the paper tray for blocking paper. A clamping angle between an axial direction of the pivoting shaft of each guiding swing arm and a paper feeding direction of the paper feeding channel is greater than 0 degree and less than 90 degrees.

As described above, the two guiding swing arms of the guiding swing arm assembly are pivotally fastened to two opposite sides of the cover by the two pivoting shafts of the two guiding swing arms, respectively, the two guiding swing arms of the guiding swing arm assembly are fastened adjacent to two opposite sides of the two pickup rollers of the pickup roller assembly, the two stopping blocks of the two guiding swing arms of the guiding swing arm assembly are disposed between the pickup roller assembly and the paper tray for blocking the paper, an angle between an action force provided by the fed paper and the axial direction of the pivoting shaft of each guiding swing arm is further changed by means of adjusting the clamping angle between the axial direction of the pivoting shaft of each guiding swing arm and the paper feeding direction of the paper feeding channel, so that an effect of changing combined torque is achieved. As a result, a paper jam condition of the pickup mechanism is improved, and the pickup mechanism picks up the paper normally.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
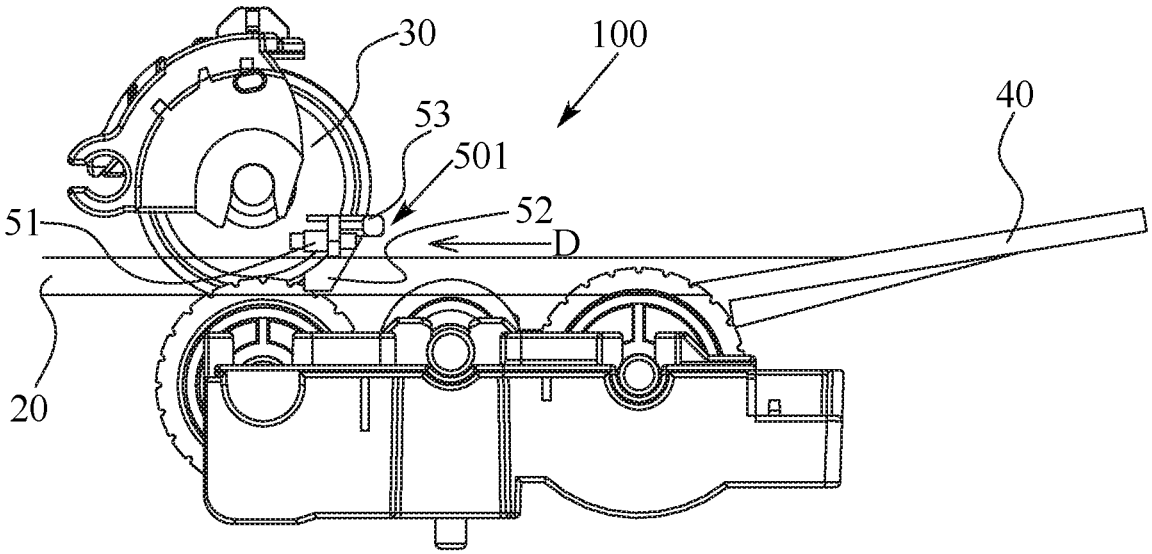
FIG. 1 is a partially schematic side diagram of a pickup mechanism in accordance with a first preferred embodiment of the present invention.
Figure 2:
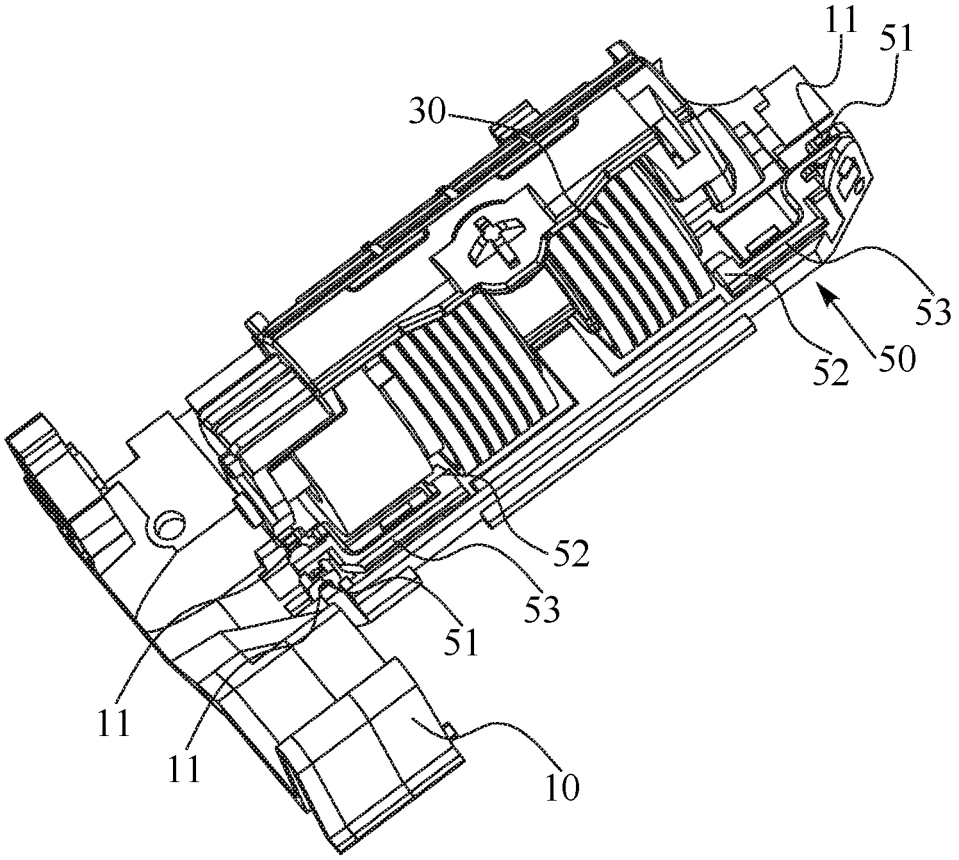
FIG. 2 is a schematic diagram showing that a pickup roller assembly of the pickup mechanism is assembled to a cover in accordance with the present invention.
Figure 3:
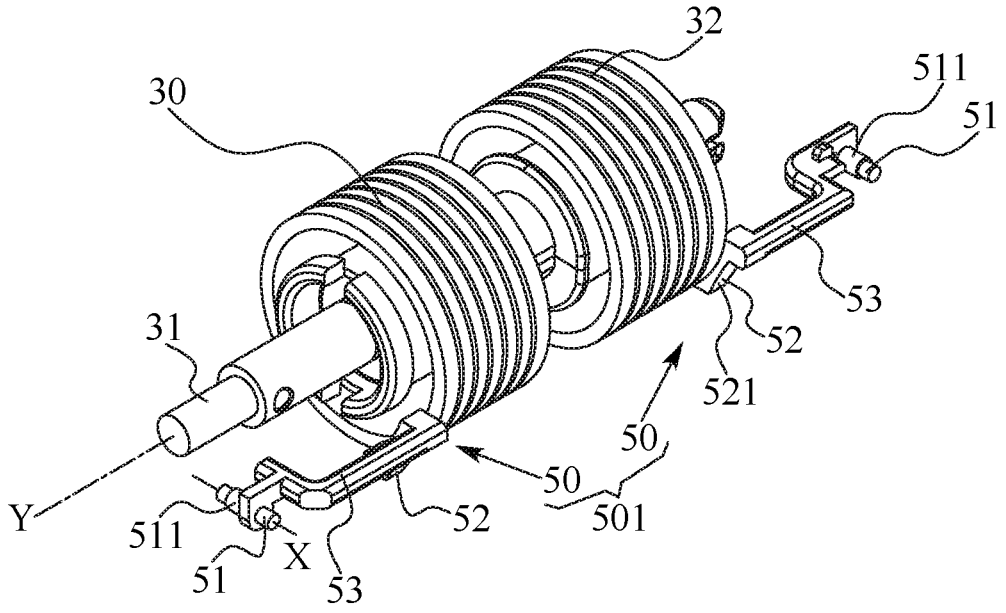
FIG. 3 is a perspective view showing the pickup roller assembly and a guiding swing arm of the pickup mechanism in accordance with the first preferred embodiment of the present invention.
Figure 4:
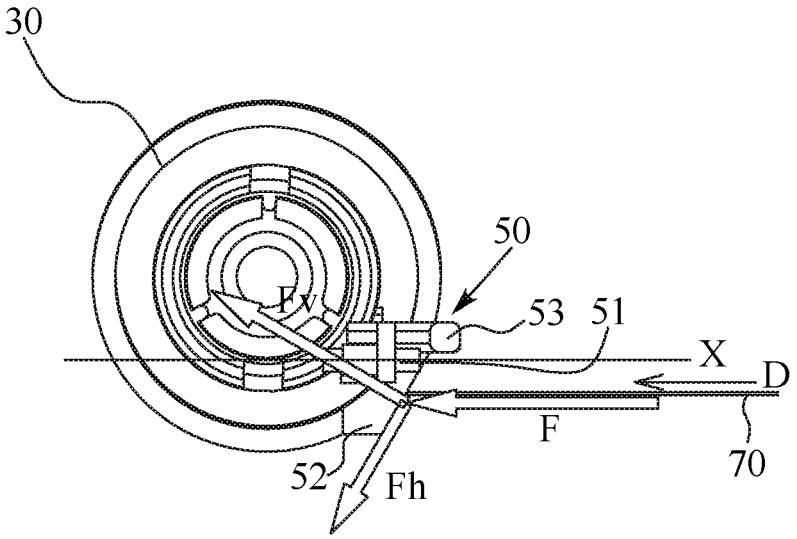
FIG. 4 is a schematic diagram showing that the guiding swing arm of the pickup mechanism in accordance with the first preferred embodiment of the present invention is pushed by paper which is to be fed.
Figure 5:
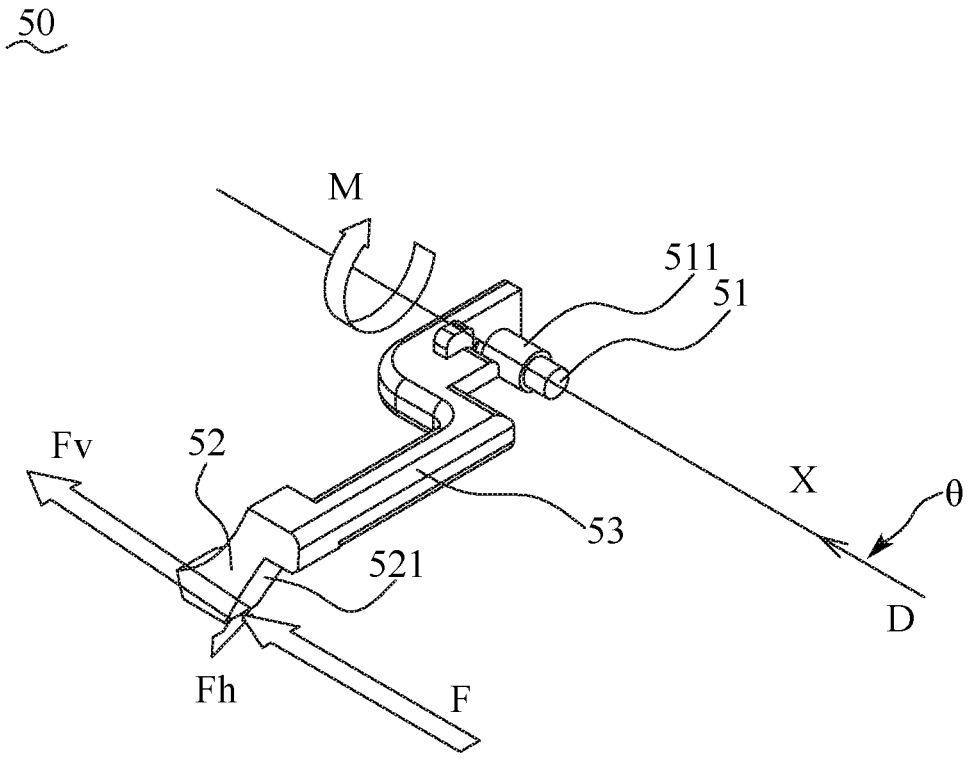
FIG. 5 is another schematic diagram showing that the guiding swing arm of the pickup mechanism in accordance with the first preferred embodiment of the present invention is pushed by the paper which is to be fed.

With reference to FIG. 1 to FIG. 5, a pickup mechanism 100 in accordance with a first preferred embodiment of the present invention is shown. The pickup mechanism 100 for feeding paper 70, includes a cover 10, a paper feeding channel 20, a pickup roller assembly 30 disposed in the paper feeding channel 20 and projecting beyond a top of the paper feeding channel 20, a paper tray 40 disposed to an upstream of the pickup roller assembly 30, and a guiding swing arm assembly 501 mounted to the cover 10.

The guiding swing arm assembly 501 is assembled to the cover 10. The guiding swing arm assembly 501 is pivotally connected to the cover 10. The guiding swing arm assembly 501 is mounted adjacent to and spaced from two opposite sides of the pickup roller assembly 30. One side of the cover 10 defines two opposite fastening grooves 11 along a front-to-rear direction. The other side of the cover 10 defines another two opposite fastening grooves 11 along the front-to-rear direction. The guiding swing arm assembly 501 includes two guiding swing arms 50. Each guiding swing arm 50 includes a pivoting shaft 51, a stopping block 52, and an extending arm 53 connected between the pivoting shaft 51 and the stopping block 52. The two guiding swing arms 50 of the guiding swing arm assembly 501 are mounted to two opposite sides of the cover 10. The two guiding swing arms 50 are mounted adjacent to and spaced from the two opposite sides of the pickup roller assembly 30. The pickup roller assembly 30 is mounted to a middle of the cover 10 and a bottom of the pickup roller assembly 30 projects beyond a bottom surface of the cover 10. The bottom of the pickup roller assembly 30 projects into the paper feeding channel 20.

The pickup roller assembly 30 includes a rotation shaft 31, and two pickup rollers 32 mounted around the rotation shaft 31. The two guiding swing arms 50 of the guiding swing arm assembly 501 are pivotally fastened to the two opposite sides of the cover 10 by the two pivoting shafts 51 of the two guiding swing arms 50, respectively. The pickup roller assembly 30 is located between the two guiding swing arms 50. The two pivoting shafts 51 of the two guiding swing arms 50 of the guiding swing arm assembly 501 are disposed adjacent to the upstream of the pickup roller assembly 30. Two opposite ends of the pivoting shaft 51 of one guiding swing arm 50 are fastened to the two opposite fastening grooves 11 of one side of the cover 10. Two opposite ends of the pivoting shaft 51 of the other guiding swing arm 50 are fastened to the two opposite fastening grooves 11 of the other side of the cover 10. A middle of the pivoting shaft 51 of each guiding swing arm 50 is surrounded by a surrounding portion 511. The two surrounding portions 511 of the two guiding swing arms 50 are disposed oppositely. The surrounding portion 511 of one guiding swing arm 50 is disposed behind the extending arm 53 of the one guiding swing arm 50 and is blocked by a rear surface of the extending arm 53 of the one guiding swing arm 50. The surrounding portion 511 of the other guiding swing arm 50 is disposed in front of the extending arm 53 of the other guiding swing arm 50 and is located in front of a front surface of the extending arm 53 of the other guiding swing arm 50. The two guiding swing arms 50 of the guiding swing arm assembly 501 are fastened adjacent to and spaced from two opposite sides of the two pickup rollers 32 of the pickup roller assembly 30.

An axial direction X of the pivoting shaft 51 of each guiding swing arm 50 is parallel with a paper feeding direction D of the paper feeding channel 20. A clamping angle θ between the axial direction X of the pivoting shaft 51 of each guiding swing arm 50 and the paper feeding direction D of the paper feeding channel 20 is 0 degree. The axial direction X of the pivoting shaft 51 of each guiding swing arm 50 is deviated from a center axis direction Y of the pickup roller assembly 30. The axial direction X of the pivoting shaft 51 of each guiding swing arm 50 is perpendicular to the center axis direction Y of the pickup roller assembly 30. Specifically, the axial direction X of the pivoting shaft 51 of each guiding swing arm 50 is deviated from the center axis direction Y of the rotation shaft 31 of the pickup roller assembly 30. The axial direction X of the pivoting shaft 51 of each guiding swing arm 50 is perpendicular to the center axis direction Y of the rotation shaft 31 of the pickup roller assembly 30. The extending arm 53 of each guiding swing arm 50 is disposed horizontally and extends towards the pickup roller assembly 30. The two stopping blocks 52 of the two guiding swing arms 50 of the guiding swing arm assembly 501 are disposed between the pickup roller assembly 30 and the paper tray 40 for blocking the paper 70.

Referring to FIG. 1 to FIG. 5 again, in a process of feeding the paper 70, when the paper 70 is blocked by the two stopping blocks 52, the fed paper 70 simultaneously exert an action force F on the two stopping blocks 52, a direction of the action force F and the paper feeding direction D are the same. Each stopping block 52 has an inclined surface 521 slantwise extending rearward from top to bottom. So the action force F will generate a component Fv perpendicular to the inclined surface 521 of each stopping block 52, and a component Fh parallel with the inclined surface 521 of each stopping block 52. The component Fv and the component Fh of the action force F generate two torques on the two guiding swing arms 50 of the guiding swing arm assembly 501, respectively. Specifically, the component Fv perpendicular to the inclined surface 521 of each stopping block 52, and the component Fh parallel with the inclined surface 521 of each stopping block 52 generate a torque MFv and a torque MFh, respectively. The torque MFv and the torque MFh are further compounded into a combined torque MF. When the fed paper 70 passes through the two guiding swing arms 50 of the guiding swing arm assembly 501, the two guiding swing arms 50 of the guiding swing arm assembly 501 raise the two stopping blocks 52 by a function of the combined torque MF. The component Fv perpendicular to the inclined surface 521 of each stopping block 52 and the component Fh parallel with the inclined surface 521 of each stopping block 52 generated by the action force F are capable of being changed by virtue of changing an inclined angle of the inclined surface 521, so that the combined torque MF is further changed.

Figure 6:
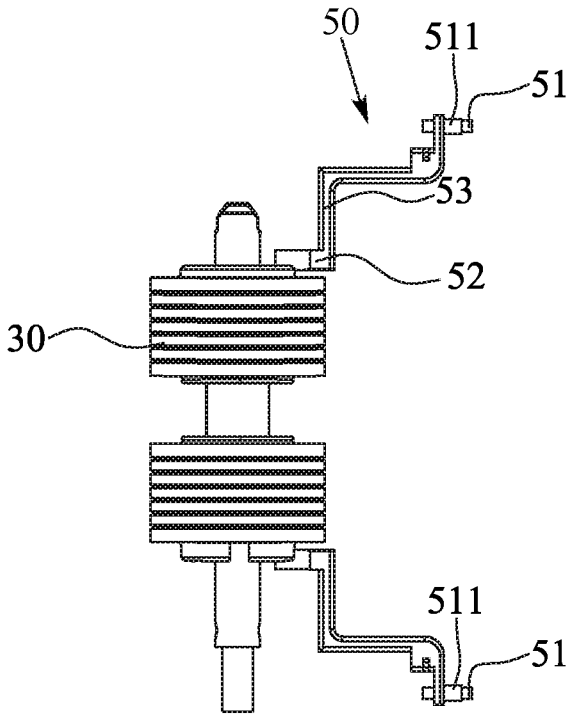
FIG. 6 is a vertical view of the pickup mechanism in accordance with a second preferred embodiment of the present invention.

Referring to FIG. 1 to FIG. 6, the pickup mechanism 100 in accordance with a second preferred embodiment of the present invention is shown. The pickup mechanism 100 in accordance with the second preferred embodiment, includes the cover 10, the paper feeding channel 20, the pickup roller assembly 30 disposed in the paper feeding channel 20, the paper tray 40 disposed to the upstream of the pickup roller assembly 30, and the two guiding swing arms 50 of the guiding swing arm assembly 501 mounted adjacent to and spaced from the two opposite sides of the pickup roller assembly 30.

The guiding swing arm assembly 501 is pivotally connected to the cover 10. The guiding swing arm assembly 501 includes the two guiding swing arms 50. Each guiding swing arm 50 includes the pivoting shaft 51, the stopping block 52, and the extending arm 53 connected between the pivoting shaft 51 and the stopping block 52. In the second preferred embodiment, the two guiding swing arms 50 of the guiding swing arm assembly 501 are pivotally fastened to and connected to the two opposite sides of the cover 10 by the two pivoting shafts 51 of the two guiding swing arms 50, respectively. The two guiding swing arms 50 of the guiding swing arm assembly 501 are fastened adjacent to and spaced from the two opposite sides of the pickup roller assembly 30, and are located adjacent to the upstream of the pickup roller assembly 30. The two pivoting shafts 51 of the two guiding swing arms 50 of the guiding swing arm assembly 501 are disposed at the upstream of the pickup roller assembly 30. The two surrounding portions 511 of the two guiding swing arms 50 are disposed in front of and blocked by front surfaces of the two extending arms 53 of the two guiding swing arms 50, respectively. The axial direction X of the pivoting shaft 51 of each guiding swing arm 50 is parallel with the paper feeding direction D of the paper feeding channel 20. The extending arm 53 of each guiding swing arm 50 is disposed horizontally and extends towards the pickup roller assembly 30. The two stopping blocks 52 of the two guiding swing arms 50 of the guiding swing arm assembly 501 are disposed between the pickup roller assembly 30 and the paper tray 40 for blocking the paper 70.

Figure 7:
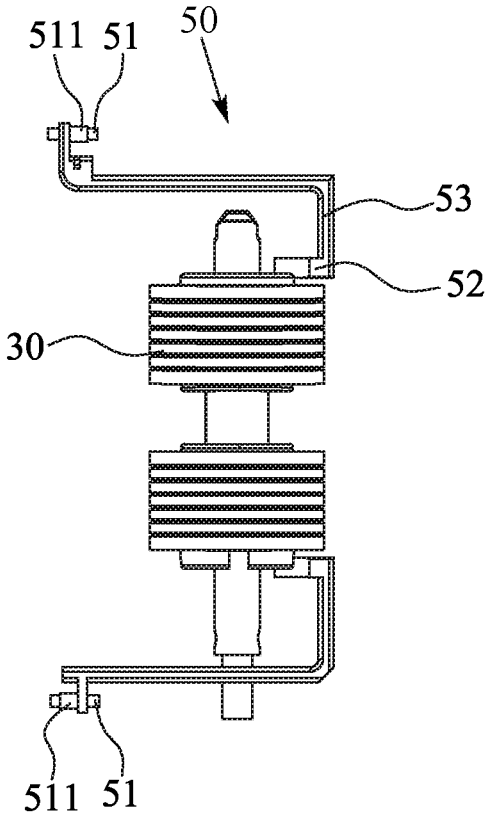
FIG. 7 is a vertical view of the pickup mechanism in accordance with a third preferred embodiment of the present invention.

Referring to FIG. 1, FIG. 2, FIG. 3, FIG. 4, FIG. 5 and FIG. 7, the pickup mechanism 100 in accordance with a third preferred embodiment of the present invention is shown. The pickup mechanism 100 in accordance with the third preferred embodiment, includes the cover 10, the paper feeding channel 20, the pickup roller assembly 30 disposed in the paper feeding channel 20, the paper tray 40 disposed to the upstream of the pickup roller assembly 30, and the two guiding swing arms 50 of the guiding swing arm assembly 501 mounted adjacent to the two opposite sides of the pickup roller assembly 30. The guiding swing arm assembly 501 is pivotally connected to the cover 10. The guiding swing arm assembly 501 includes the two guiding swing arms 50. Each guiding swing arm 50 includes the pivoting shaft 51, the stopping block 52, and the extending arm 53 connected between the pivoting shaft 51 and the stopping block 52. In the third preferred embodiment, the two guiding swing arms 50 of the guiding swing arm assembly 501 are pivotally fastened to the two opposite sides of the cover 10 by the two pivoting shafts 51 of the two guiding swing arms 50, respectively. The two guiding swing arms 50 are located adjacent to the two opposite sides of the pickup roller assembly 30 and project into a downstream of the pickup roller assembly 30. The two pivoting shafts 51 of the two guiding swing arms 50 of the guiding swing arm assembly 501 are disposed at the downstream of the pickup roller assembly 30. The two surrounding portions 511 of the two guiding swing arms 50 are disposed oppositely. The surrounding portion 511 of the one guiding swing arm 50 is disposed behind the extending arm 53 of the one guiding swing arm 50 and is blocked by the rear surface of the extending arm 53 of the one guiding swing arm 50. The surrounding portion 511 of the other guiding swing arm 50 is disposed in front of the extending arm 53 of the other guiding swing arm 50 and is located in front of the front surface of the extending arm 53 of the other guiding swing arm 50. The axial direction X of the pivoting shaft 51 of each guiding swing arm 50 is parallel with the paper feeding direction D of the paper feeding channel 20. The extending arm 53 of each guiding swing arm 50 is disposed horizontally and extends towards the pickup roller assembly 30. The two stopping blocks 52 of the two guiding swing arms 50 of the guiding swing arm assembly 501 are disposed between the pickup roller assembly 30 and the paper tray 40 for blocking the paper 70.

Figure 8:
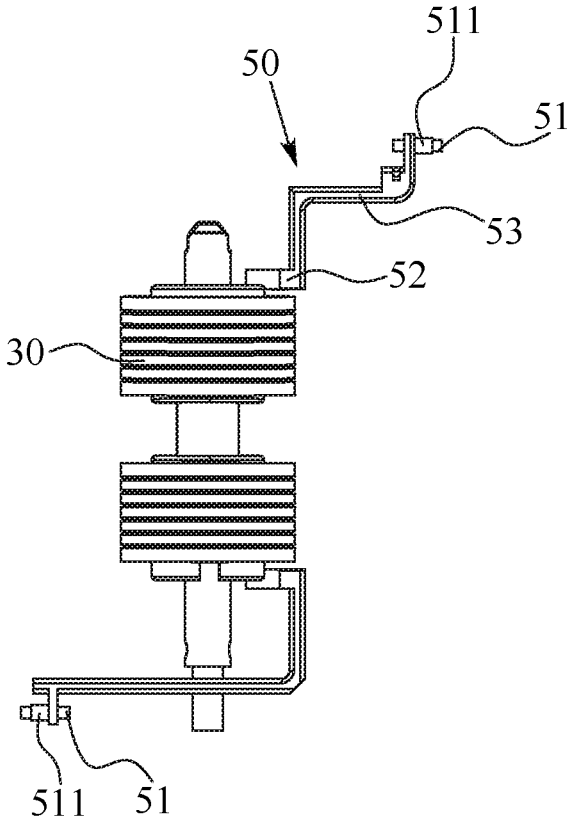
FIG. 8 is a vertical view of the pickup mechanism in accordance with a fourth preferred embodiment of the present invention.

Referring to FIG. 1, FIG. 2, FIG. 3, FIG. 4, FIG. 5 and FIG. 8, the pickup mechanism 100 in accordance with a fourth preferred embodiment of the present invention is shown. The pickup mechanism 100 in accordance with the fourth preferred embodiment, includes the cover 10, the paper feeding channel 20, the pickup roller assembly 30 disposed in the paper feeding channel 20, the paper tray 40 disposed to the upstream of the pickup roller assembly 30, and the two guiding swing arms 50 of the guiding swing arm assembly 501 mounted adjacent to the two opposite sides of the pickup roller assembly 30. The guiding swing arm assembly 501 is pivotally connected to the cover 10. The guiding swing arm assembly 501 includes the two guiding swing arms 50. Each guiding swing arm 50 includes the pivoting shaft 51, the stopping block 52, and the extending arm 53 connected between the pivoting shaft 51 and the stopping block 52. In the fourth preferred embodiment, the two guiding swing arms 50 of the guiding swing arm assembly 501 are pivotally fastened to the two opposite sides of the cover 10 by the two pivoting shafts 51 of the two guiding swing arms 50, respectively. The two guiding swing arms 50 are fastened adjacent to the two opposite sides of the pickup roller assembly 30. One of the two pivoting shafts 51 of the two guiding swing arms 50 of the guiding swing arm assembly 501 is disposed to the upstream of the pickup roller assembly 30 and the other one of the two pivoting shafts 51 of the two guiding swing arms 50 is disposed to the downstream of the pickup roller assembly 30, respectively. The two surrounding portions 511 of the two guiding swing arms 50 are disposed oppositely. The surrounding portion 511 of the one guiding swing arm 50 is disposed behind the extending arm 53 of the one guiding swing arm 50 and is blocked by the rear surface of the extending arm 53 of the one guiding swing arm 50. The surrounding portion 511 of the other guiding swing arm 50 is disposed in front of the extending arm 53 of the other guiding swing arm 50 and is located in front of the front surface of the extending arm 53 of the other guiding swing arm 50. The axial direction X of the pivoting shaft 51 of each guiding swing arm 50 is parallel with the paper feeding direction D of the paper feeding channel 20. The extending arm 53 of each guiding swing arm 50 is disposed horizontally and extends towards the pickup roller assembly 30. The two stopping blocks 52 of the two guiding swing arms 50 of the guiding swing arm assembly 501 are disposed between the pickup roller assembly 30 and the paper tray 40 for blocking the paper 70.

Figure 9:
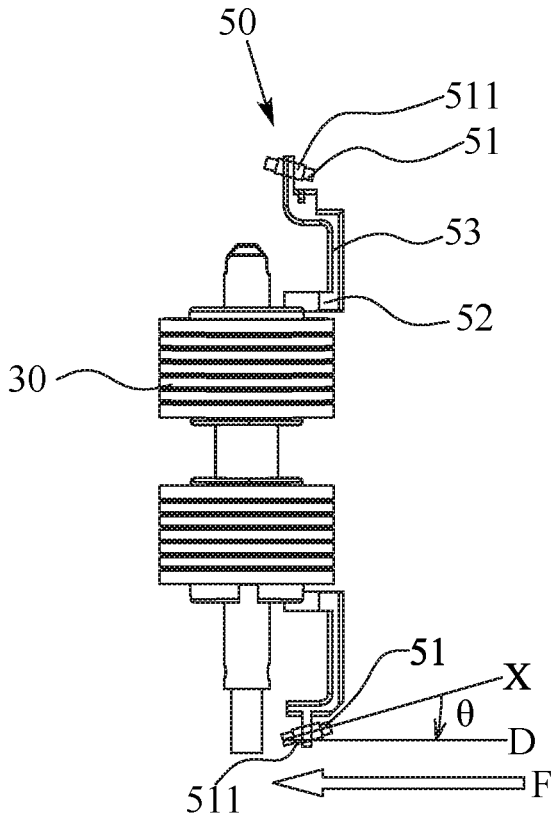
FIG. 9 is a vertical view of the pickup mechanism in accordance with a fifth preferred embodiment of the present invention.

Referring to FIG. 1, FIG. 2, FIG. 3, FIG. 4, FIG. 5 and FIG. 9, the pickup mechanism 100 in accordance with a fifth preferred embodiment of the present invention is shown. The pickup mechanism 100 in accordance with the fifth preferred embodiment, includes the cover 10, the paper feeding channel 20, the pickup roller assembly 30 disposed in the paper feeding channel 20, the paper tray 40 disposed to the upstream of the pickup roller assembly 30, and the two guiding swing arms 50 of the guiding swing arm assembly 501 mounted adjacent to the two opposite sides of the pickup roller assembly 30. The guiding swing arm assembly 501 is pivotally connected to the cover 10. The guiding swing arm assembly 501 includes the two guiding swing arms 50. Each guiding swing arm 50 includes the pivoting shaft 51, the stopping block 52, and the extending arm 53 connected between the pivoting shaft 51 and the stopping block 52. The pickup roller assembly 30 includes the rotation shaft 31, and the two pickup rollers 32 mounted around the rotation shaft 31. In the fifth preferred embodiment, the two guiding swing arms 50 of the guiding swing arm assembly 501 are pivotally fastened to the two opposite sides of the cover 10 by the two pivoting shafts 51 of the two guiding swing arms 50, respectively. The two guiding swing arms 50 are fastened adjacent to the two opposite sides of the pickup roller assembly 30. The two pivoting shafts 51 of the two guiding swing arms 50 are disposed adjacent to the upstream of the pickup roller assembly 30.

The two surrounding portions 511 of the two guiding swing arms 50 are disposed oppositely with respect to the two pickup rollers 32 of the pickup roller assembly 30. The surrounding portions 511 of the two guiding swing arms 50 pass through two opposite sides of the two extending arms 53 of the two guiding swing arms 50, respectively. A front end and a rear end of the surrounding portion 511 of each guiding swing arm 50 project beyond a front surface and a rear surface of each guiding swing arm 50, respectively. The front end and the rear end of the surrounding portion 511 of each guiding swing arm 50 project beyond the front surface and the rear surface of the extending arm 53 of each guiding swing arm 50. The clamping angle θ between the axial direction X of the pivoting shaft 51 of each guiding swing arm 50 and the paper feeding direction D of the paper feeding channel 20 is greater than 0 degree and less than 90 degrees. The extending arm 53 of each guiding swing arm 50 is disposed horizontally and extends towards the pickup roller assembly 30. The two stopping blocks 52 of the two guiding swing arms 50 of the guiding swing arm assembly 501 are disposed between the pickup roller assembly 30 and the paper tray 40 for blocking the paper 70.

Figure 10:
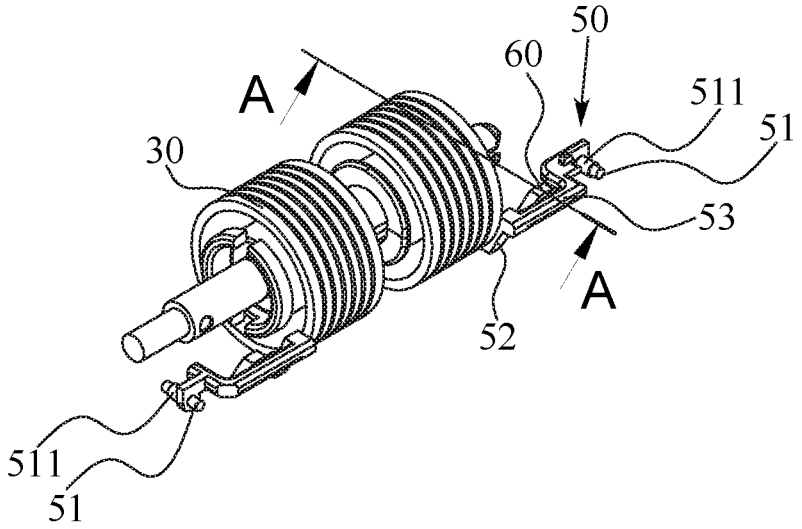
FIG. 10 is a perspective view of the pickup mechanism in accordance with a sixth preferred embodiment of the present invention.

Referring to FIG. 1, FIG. 2, FIG. 3, FIG. 4, FIG. 5 and FIG. 10, the pickup mechanism 100 in accordance with a sixth preferred embodiment of the present invention is shown. Differences between the pickup mechanism 100 in accordance with the first preferred embodiment of the present invention and the pickup mechanism 100 in accordance with the sixth preferred embodiment of the present invention are described as follows. In the sixth embodiment, in order to further increase a paper separation capability of the pickup mechanism 100 in accordance with the sixth preferred embodiment of the present invention, each guiding swing arm 50 of the pickup mechanism 100 is further equipped with a stopping piece 60. The stopping piece 60 is disposed to and contacts with one side of the extending arm 53 of each guiding swing arm 50. A resistance force is exerted on the extending arm 53 through the stopping piece 60, and the stopping piece 60 increases a paper blocking capacity of the two stopping blocks 52 of the two guiding swing arms 50.

Figure 11:
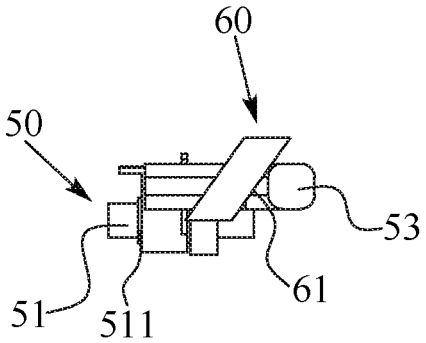
FIG. 11 is a perspective view of the pickup mechanism in accordance with a seventh preferred embodiment of the present invention.

Referring to FIG. 1, FIG. 2, FIG. 3, FIG. 4, FIG. 5 and FIG. 11, the pickup mechanism 100 in accordance with a seventh preferred embodiment of the present invention is shown. Differences between the pickup mechanism 100 in accordance with the first preferred embodiment of the present invention and the pickup mechanism 100 in accordance with the seventh preferred embodiment of the present invention are described as follows. In the seventh embodiment, each guiding swing arm 50 of the pickup mechanism 100 is further equipped with the stopping piece 60. In the seventh preferred embodiment, a front surface of the stopping piece 60 of each guiding swing arm 50 is defined as a contact surface 61. The contact surface 61 of the stopping piece 60 of each guiding swing arm 50 contacting with the extending arm 53 of each guiding swing arm 50 is disposed as an inclined face slantwise extending rearward from top to bottom, so at an initial stage of the fed paper 70 contacting with the two stopping blocks 52 of the two guiding swing arms 50, the stopping piece 60 is without providing an extra resistance force to the extending arm 53. Nonetheless, when the two stopping blocks 52 of the two guiding swing arms 50 are raised to a certain height, the stopping piece 60 contacts with the extending arm 53 to provide the extra resistance force to the extending arm 53 for increasing the paper blocking capacity of the two stopping blocks 52 of the two guiding swing arms 50.

Figure 12:
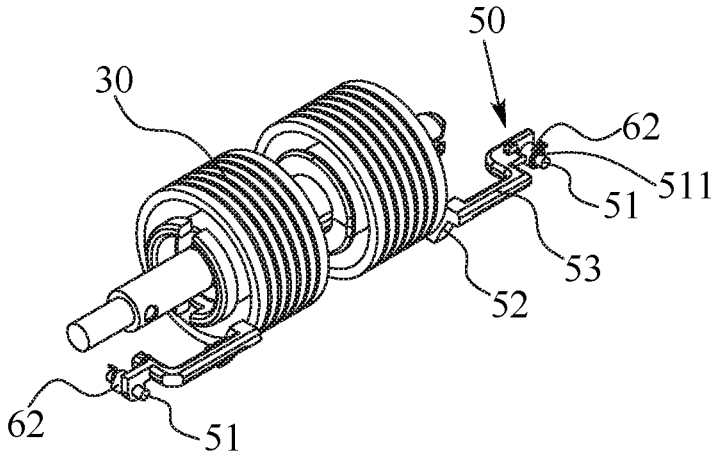
FIG. 12 is a perspective view of the pickup mechanism in accordance with an eighth preferred embodiment of the present invention.

Referring to FIG. 1, FIG. 2, FIG. 3, FIG. 4, FIG. 5 and FIG. 12, the pickup mechanism 100 in accordance with an eighth preferred embodiment of the present invention is shown. Differences between the pickup mechanism 100 in accordance with the first preferred embodiment of the present invention and the pickup mechanism 100 in accordance with the eighth preferred embodiment of the present invention are described as follows. In the eighth embodiment, in order to further increase the paper separation capability of the pickup mechanism 100 in accordance with the eighth preferred embodiment of the present invention, the pickup mechanism 100 in accordance with the eighth preferred embodiment of the present invention further includes a torsion spring 62. Preferably, the pickup mechanism 100 in accordance with the eighth preferred embodiment of the present invention further includes two torsion springs 62. Because the two guiding swing arms 50 of the guiding swing arm assembly 501 are pivotally fastened to the two opposite sides of the cover 10 by the two pivoting shafts 51 of the two guiding swing arms 50, respectively, the two torsion springs 62 are disposed to and worn around the surrounding portions 511 of the two pivoting shafts 51 of the two guiding swing arms 50, respectively for exerting two restoration torques on the extending arms 53 of the two guiding swing arms 50, respectively and increasing the paper blocking capacity of the two stopping blocks 52 of the two guiding swing arms 50.

Figure 13:
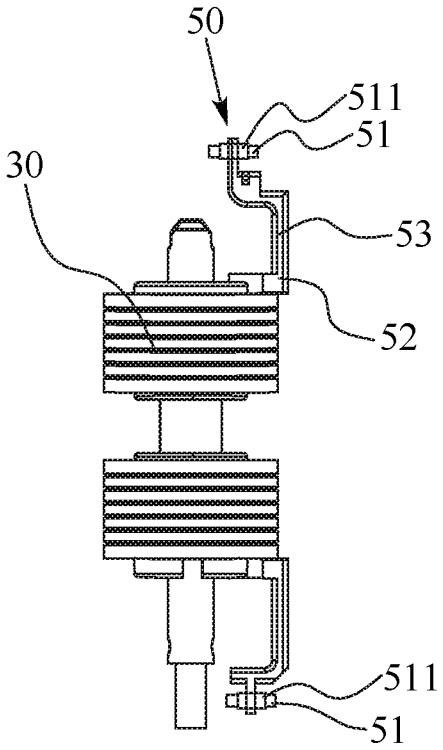
FIG. 13 is a perspective view of the pickup mechanism in accordance with a ninth preferred embodiment of the present invention.

Referring to FIG. 1, FIG. 2, FIG. 3, FIG. 4, FIG. 5 and FIG. 13, the pickup mechanism 100 in accordance with a ninth preferred embodiment of the present invention is shown. Differences between the pickup mechanism 100 in accordance with the first preferred embodiment and the pickup mechanism 100 in accordance with the ninth preferred embodiment are described as follows. In the ninth embodiment, in order to further increase the paper separation capability of the pickup mechanism 100 in accordance with the ninth preferred embodiment of the present invention, the extending arms 53 of the two guiding swing arms 50 contact with the two opposite sides of the pickup roller assembly 30, specifically, the extending arms 53 of the two guiding swing arms 50 contact with two opposite sides of the two pickup rollers 32 of the pickup roller assembly 30, and the resistance force is exerted on the extending arms 53 of the two guiding swing arms 50 through the pickup roller assembly 30, and the pickup roller assembly 30 increases the paper blocking capacity of the two stopping blocks 52 of the two guiding swing arms 50.

Figure 14:
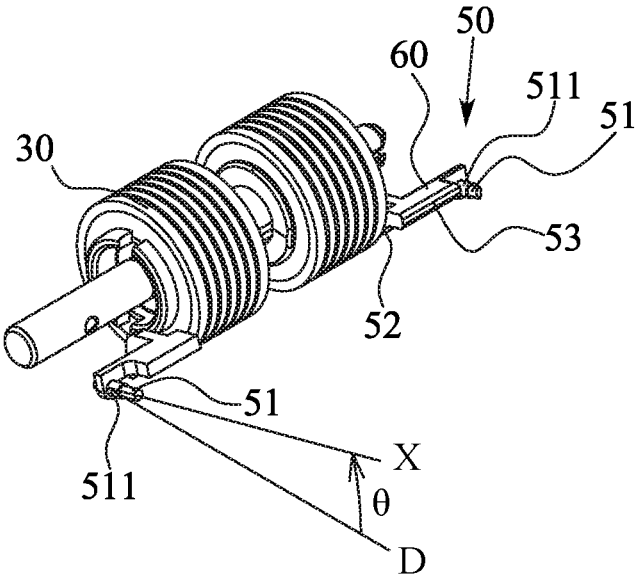
FIG. 14 is a perspective view of the pickup mechanism in accordance with a tenth preferred embodiment of the present invention.

Referring to FIG. 1, FIG. 2, FIG. 3, FIG. 4, FIG. 5 and FIG. 14, the pickup mechanism 100 in accordance with a tenth preferred embodiment of the present invention is shown. Differences between the pickup mechanism 100 in accordance with the first preferred embodiment and the pickup mechanism 100 in accordance with the tenth preferred embodiment are described as follows. Because each guiding swing arm 50 includes the pivoting shaft 51, the stopping block 52, and the extending arm 53 connected between the pivoting shaft 51 and the stopping block 52, and the two pivoting shafts 51 of the two guiding swing arms 50 slantwise extend upward and frontward, so the clamping angle θ between the axial direction X of the pivoting shaft 51 of each guiding swing arm 50 and the paper feeding direction D of the paper feeding channel 20 is formed, and the clamping angle θ between the axial direction X of the pivoting shaft 51 of each guiding swing arm 50 and the paper feeding direction D of the paper feeding channel 20 is an elevation angle.

Figure 15:
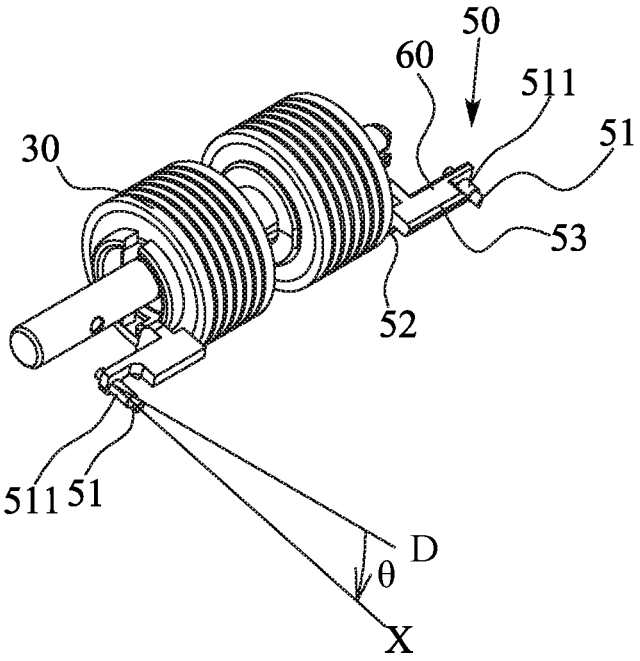
FIG. 15 is a perspective view of the pickup mechanism in accordance with an eleventh preferred embodiment of the present invention.

Referring to FIG. 1, FIG. 2, FIG. 3, FIG. 4, FIG. 5 and FIG. 15, the pickup mechanism 100 in accordance with an eleventh preferred embodiment of the present invention is shown. Differences between the pickup mechanism 100 in accordance with the first preferred embodiment and the pickup mechanism 100 in accordance with the eleventh preferred embodiment are described as follows. Because each guiding swing arm 50 includes the pivoting shaft 51, the stopping block 52, and the extending arm 53 connected between the pivoting shaft 51 and the stopping block 52, and the two pivoting shafts 51 of the two guiding swing arms 50 slantwise extend downward and frontward, so the clamping angle θ between the axial direction X of the pivoting shaft 51 of each guiding swing arm 50 and the paper feeding direction D of the paper feeding channel 20 is formed, and the clamping angle θ between the axial direction X of the pivoting shaft 51 of each guiding swing arm 50 and the paper feeding direction D of the paper feeding channel 20 is a depression angle.

The pickup mechanism 100 in accordance with the present invention, an angle between the action force F provided by the fed paper 70 and the axial direction X of the pivoting shaft 51 of each guiding swing arm 50 is further changed by means of adjusting the clamping angle θ between the axial direction X of the pivoting shaft 51 of each guiding swing arm 50 and the paper feeding direction D of the paper feeding channel 20, so that an effect of changing the combined torque MF is achieved.

As described above, the two guiding swing arms 50 of the guiding swing arm assembly 501 are pivotally fastened to the two opposite sides of the cover 10 by the two pivoting shafts 51 of the two guiding swing arms 50, respectively, the two guiding swing arms 50 of the guiding swing arm assembly 501 are fastened adjacent to the two opposite sides of the two pickup rollers 32 of the pickup roller assembly 30, the two stopping blocks 52 of the two guiding swing arms 50 of the guiding swing arm assembly 501 are disposed between the pickup roller assembly 30 and the paper tray 40 for blocking the paper 70, the angle between the action force F provided by the fed paper 70 and the axial direction X of the pivoting shaft 51 of each guiding swing arm 50 is further changed by means of adjusting the clamping angle θ between the axial direction X of the pivoting shaft 51 of each guiding swing arm 50 and the paper feeding direction D of the paper feeding channel 20, so that the effect of changing the combined torque MF is achieved. As a result, a paper jam condition of the pickup mechanism 100 is improved, and the pickup mechanism 100 picks up the paper 70 normally.

What is claimed is:

1. A pickup mechanism, comprising:

a paper feeding channel;

a pickup roller assembly disposed in the paper feeding channel and projecting beyond a top of the paper feeding channel;

a paper tray disposed to an upstream of the pickup roller assembly; and a guiding swing arm assembly including two guiding swing arms mounted adjacent to and spaced from two opposite sides of the pickup roller assembly, each guiding swing arm including a pivoting shaft, a stopping block, and an extending arm connected between the pivoting shaft and the stopping block, the two stopping blocks of the two guiding swing arms being disposed between the pickup roller assembly and the paper tray for blocking paper, an axial direction of the pivoting shaft of each guiding swing arm being deviated from a center axis direction of the pickup roller assembly;

wherein the two pivoting shafts of the two guiding swing arms of the guiding swing arm assembly are disposed at a downstream of the pickup roller assembly.

2. The pickup mechanism as claimed in claim 1, wherein the two pivoting shafts of the two guiding swing arms of the guiding swing arm assembly are disposed at the upstream of the pickup roller assembly.

3. The pickup mechanism as claimed in claim 1, wherein one of the two pivoting shafts of the two guiding swing arms of the guiding swing arm assembly is disposed to the upstream of the pickup roller assembly and the other one of the two pivoting shafts of the two guiding swing arms is disposed to a downstream of the pickup roller assembly, respectively.

4. The pickup mechanism as claimed in claim 1, wherein the two pivoting shafts of the two guiding swing arms of the guiding swing arm assembly are disposed adjacent to the upstream of the pickup roller assembly.

5. The pickup mechanism as claimed in claim 1, wherein each guiding swing arm is further equipped with a stopping piece, the stopping piece is disposed to and contacts with one side of the extending arm of each guiding swing arm.

6. The pickup mechanism as claimed in claim 5, wherein a front surface of the stopping piece of each guiding swing arm is defined as a contact surface, the contact surface of the stopping piece of each guiding swing arm contacts with the extending arm of each guiding swing arm is disposed as an inclined face slantwise extending rearward from top to bottom.

7. The pickup mechanism as claimed in claim 1, further comprising two torsion springs, the two torsion springs being disposed to and worn around the two pivoting shafts of the two guiding swing arms, respectively.

8. The pickup mechanism as claimed in claim 1, wherein the extending arms of the two guiding swing arms contact with the two opposite sides of the pickup roller assembly.

9. The pickup mechanism as claimed in claim 1, wherein the axial direction of the pivoting shaft of each guiding swing arm is parallel with a paper feeding direction of the paper feeding channel, a clamping angle between the axial direction of the pivoting shaft of each guiding swing arm and the paper feeding direction of the paper feeding channel is 0 degree.

10. The pickup mechanism as claimed in claim 1, wherein a clamping angle between the axial direction of the pivoting shaft of each guiding swing arm and a paper feeding direction of the paper feeding channel is greater than 0 degree and less than 90 degrees.

11. The pickup mechanism as claimed in claim 1, wherein the axial direction of the pivoting shaft of each guiding swing arm is perpendicular to the center axis direction of the pickup roller assembly.

12. The pickup mechanism as claimed in claim 1, wherein the pickup roller assembly includes a rotation shaft, and two pickup rollers mounted around the rotation shaft, the extending arms of the two guiding swing arms contact with two opposite sides of the two pickup rollers of the pickup roller assembly.

13. The pickup mechanism as claimed in claim 1, wherein the pickup roller assembly includes a rotation shaft, the axial direction of the pivoting shaft of each guiding swing arm is perpendicular to a center axis direction of the rotation shaft of the pickup roller assembly.

14. The pickup mechanism as claimed in claim 1, further comprising a cover, the guiding swing arm assembly being pivotally connected to the cover, the two guiding swing arms of the guiding swing arm assembly being mounted to two opposite sides of the cover.

15. A pickup mechanism, comprising:

a paper feeding channel;

a pickup roller assembly disposed in the paper feeding channel and projecting beyond a top of the paper feeding channel, the pickup roller assembly including a rotation shaft and two pickup rollers mounted around the rotation shaft;

a paper tray disposed to an upstream of the pickup roller assembly; and a guiding swing arm assembly including two guiding swing arms mounted adjacent to and spaced from two opposite sides of the pickup roller assembly, each guiding swing arm including a pivoting shaft, a stopping block, and an extending arm connected between the pivoting shaft and the stopping block, the two stopping blocks of the two guiding swing arms being disposed between the pickup roller assembly and the paper tray for blocking paper, an axial direction of the pivoting shaft of each guiding swing arm being parallel with a paper feeding direction of the paper feeding channel;

wherein the extending arms of the two guiding swing arms contact with two opposite sides of the two pickup rollers of the pickup roller assembly.

16. The pickup mechanism as claimed in claim 15, wherein the pickup roller assembly includes a rotation shaft, and two pickup rollers mounted around the rotation shaft, the axial direction of the pivoting shaft of each guiding swing arm is deviated from a center axis direction of the rotation shaft of the pickup roller assembly.

17. The pickup mechanism as claimed in claim 15, wherein the pickup roller assembly includes a rotation shaft, and two pickup rollers mounted around the rotation shaft, the axial direction of the pivoting shaft of each guiding swing arm is perpendicular to a center axis direction of the rotation shaft of the pickup roller assembly.

18. A pickup mechanism, comprising:

a paper feeding channel;

a pickup roller assembly disposed in the paper feeding channel and projecting beyond a top of the paper feeding channel;

a paper tray disposed to an upstream of the pickup roller assembly; and a guiding swing arm assembly including two guiding swing arms mounted adjacent to and spaced from two opposite sides of the pickup roller assembly, each guiding swing arm including a pivoting shaft, a stopping block, and an extending arm connected between the pivoting shaft and the stopping block, the two stopping blocks of the two guiding swing arms being disposed between the pickup roller assembly and the paper tray for blocking paper, a clamping angle between an axial direction of the pivoting shaft of each guiding swing arm and a paper feeding direction of the paper feeding channel being greater than 0 degree and less than 90 degrees.

* * * * *